United States Patent [19]

Waites et al.

[11] Patent Number: 4,834,387

[45] Date of Patent: May 30, 1989

[54] GOLF CLUB

[76] Inventors: Brian J. Waites, 21 Southpark Avenue, Southlands, Mansfield, Nottinghamshire, United Kingdom; James S. B. Mather, 18 Plains Farm Close, Mapperley Plains, Nottingham, United Kingdom, NG3 5RE; Dennis Vardy, 11 Shady Lane, Attenborough, Nottingham, United Kingdom

[21] Appl. No.: 95,567

[22] Filed: Sep. 11, 1987

[30] Foreign Application Priority Data

Sep. 13, 1986 [GB] United Kingdom ..... 8622128
Dec. 18, 1986 [GB] United Kingdom ..... 8630258

[51] Int. Cl.[4] ..... A63B 53/04

[52] U.S. Cl. ..... 273/164; 273/169; 273/172; 273/175; 273/80 A; 273/80 C; 273/167 H

[58] Field of Search ..... 273/172, 171, 169, 170, 273/167 A, 167 F, 167 H, 167 J, 164, 175, 80 A, 80 C

[56] References Cited

U.S. PATENT DOCUMENTS

| | | | |
|---|---|---|---|
| 2,932,515 | 4/1960 | May | 273/171 |
| 3,220,733 | 11/1965 | Saleeby | 273/171 |
| 4,714,252 | 12/1987 | Roraback | 273/171 |
| 4,722,528 | 2/1988 | Tsao | 273/172 |

*Primary Examiner*—George J. Mario
*Attorney, Agent, or Firm*—Bachman & LaPointe

[57] ABSTRACT

The club provides a larger permissible area of impact for striking a golf ball accurately in both direction and distance by having a lightweight upper section and a heavy sole plate section giving a centre of gravity which is low down in relation to the height of the head of the club and which is positioned towards the toe end of the head remote from the entry point of the shaft which is towards the heel of the club. The position of the centre of gravity and the swing weight of the club are adjustable by means of additional weights which may be attached within the hollow upper part of the club.

15 Claims, 4 Drawing Sheets

GOLF CLUB

The present invention relates to golf clubs and more particularly but not exclusively to putters.

A problem which exists with most golf clubs is that they are designed with a specific "sweet spot"—that is a defined point of the club face which when the club contacts the ball at that spot will propel the ball the greatest distance. With respect to professional golfers this is acceptable because they normally strike the golf ball with the same part of the club face through long practice. With respect to the average golfer however there is a considerable variation of the point of contact with the ball. Whilst such variation is perhaps only ⅛ to ¼ of an inch (3 to 6 mm) the effect on the distance travelled by the ball for a given force of shot can be considerable. With respect particularly to putters the most important factors in judgement are the accurate line and the length of the putt. On a relatively flat green it is not difficult to achieve the correct line but it often happens that the distance is badly misjudged. As explained above there are two factors in distance; firstly striking the ball with the correct force and secondly striking the ball at the correct point of the club face. For the average amateur player the combination of selecting, and administering the correct force to the ball coupled with the problem of hitting the ball with the correct point of contact of the putter is very difficult to achieve. Thus, often a first incorrectly weighted putt is put down to an incorrect force and for a second putt the golfer compensates by hitting the ball harder or softer. If the first putt was due to an incorrect striking of the ball then there is a good chance that the second putt will be again too hard or too soft. If, to compensate, the ball is struck with a different force and with a different point on the face of the putter, again, wrong distance will occur.

A further problem which exists with golf clubs in general and putters in particular lies in the fact that although the correct line may be selected, if the ball is struck with the wrong point of contact of the club then this may produce an angular movement (or twisting) of the putter resulting in the ball taking a different line than intended.

At the present time there are two main types of putter on the market these being the blade putter and the heel-toe weighted putter. The disadvantage of the blade putter is that because it has a centrally placed centre of gravity and a heel mounted shaft this produces only a small variation of feel with error of impact but always has a substantial angular motion with consequent inaccuracy.

The disadvantage of the heel-toe weighted putters particularly with face balancing having shaft entry points close to the line of the centre of gravity (central shafted) is that they are very sensitive to the point at which the ball impacts. Minor lateral variations of impact produce substantial angular movements of the putter face and, although these do not generally produce large inaccuracies except for long putts they do produce large variations in the feel of the strike, accompanied by loss of distance on the putt. This, as explained above, leads to a lack of confidence in the putter for the amateur golfers who is unable to strike the ball on the sweet spot every time.

It is an object of the present invention to produce a golf club and in particular a putter which combines together the good points of the above two known putters and to produce a putter with low angular acceleration and a good "feel" over a wide area of impact. Additionally it is a further object to provide a putter which allows the golfer to operate the putter consistently to minimise inaccuracy for any reasonable length of putt (up to say 15 meters) by building in further features which will become apparent.

The present invention thereby provides a golf club comprising a shaft and a head, the head including a fixing hole for reception of the shaft, the hole being offset from the centre of gravity of the head, the head comprising an upper lightweight block having the fixing hole provided therein and a lower base plate member of denser material secured to the upper lightweight block.

Preferably the upper part of the head is a hollow block of lightweight material (such as aluminum) and is designed to house an added weight made of the same material as the base plate member. The weight is preferably positioned at the toe end of the upper member and made from a high density material (such as brass).

The shaft of the club is preferably angled at a point close to the entry of the shaft into the fixing hole. The angle and the point along the shaft are selectable to produce different playing characteristics for a given design of head, within the ruling allowed by the R & A and other governing bodies.

Embodiments of the present invention will now be described, by way of example with reference to the accompanying drawings in which.

Figure 1:
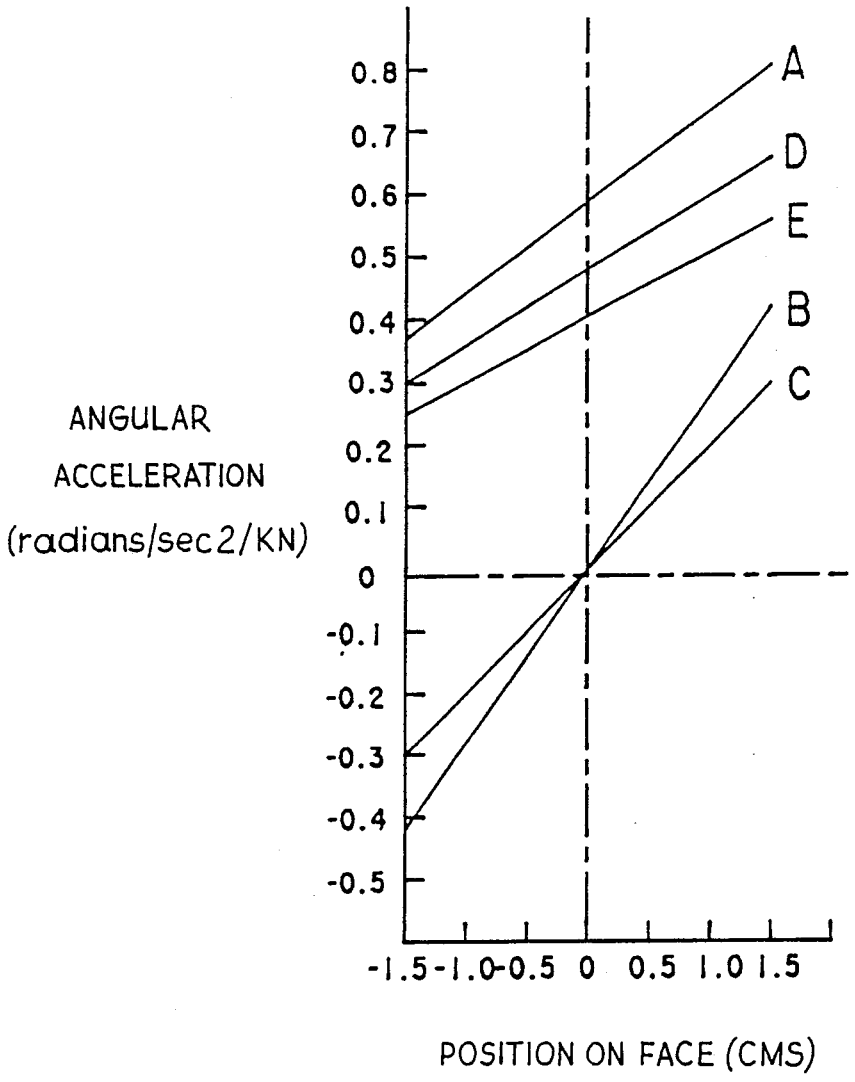
FIG. 1 shows a graph of angular acceleration variation plotted against ball contact position on the face of a number of putters to illustrate a first basic problem in putting.

With reference now to FIG. 1 the simplified straight line graphs A, B and C show respectively the variation in angular acceleration with position on the face of the putter for a blade type of putter (A) and for two known heel-toe putters (B and C).

Taking firstly the blade type it may be seen that it always has an angular acceleration (because the shaft is mounted in the heel of the blade and the centre of gravity is thereby always offset from the shaft mounting position) and that this increases or decreases from a zero impact position on the blade. The graph line is fairly steep but not excessively so such that for a 0.5 cms change in point of contact there is less than 0.06 radian per $secs^2$ per KN (RSN) variation in angular acceleration.

For the first heel-toe putter (B) the graph line is much steeper and a variation of 0.15 RSN is obtained. For the putter of graph C this variation has been reduced to 0.1 but this is still significantly worse than the blade putter of graph A. The important feature of the heel-toe putters B and C is shown by the graph of angular acceleration versus position passing through the (0, 0) point indicating that if struck absolutely correctly no angular acceleration is imparted to the club. The problem however is that between a variation of plus or minus 0.5 cms in striking position the difference in feel of the putter is much greater than for this tolerance in the blade putter leading to a lack of judgement between putts for the amateur golfer.

Thus, the blade putter gives a better feel because once the amateur golfer has accommodated for the ever present angular acceleration (often by toeing in the face) the feel varies less with inaccurate striking of the ball. For longer putts particularly, the high (0.4 and above) angular acceleration will result in inaccurate line of putt even if the distance is correct.

The characteristics of two of the designs of putter according to the present invention are shown in graphs D and E. In both cases the average angular acceleration at the centre position (0 on the position axis) is less than for the blade putter (graph A). In addition for design D the angular acceleration difference for a 0.5 cms variation of position is 0.6 RSN against 0.075 RSN for the blade putter and for design E which has more weight at the toe end of the blade it is only 0.05 RSN which is approximately half that of the best heel-toe putter.

Thus, the putter according to the present invention combines together the best characteristics of the two known types of putter to produce a putter which has a lower angular acceleration than a blade putter but with less variation of angular acceleration with position than either a heel-toe putter or even a blade putter.

The putter is also provided with other features which enable easier striking of the ball than with a blade putter.

Figure 2:
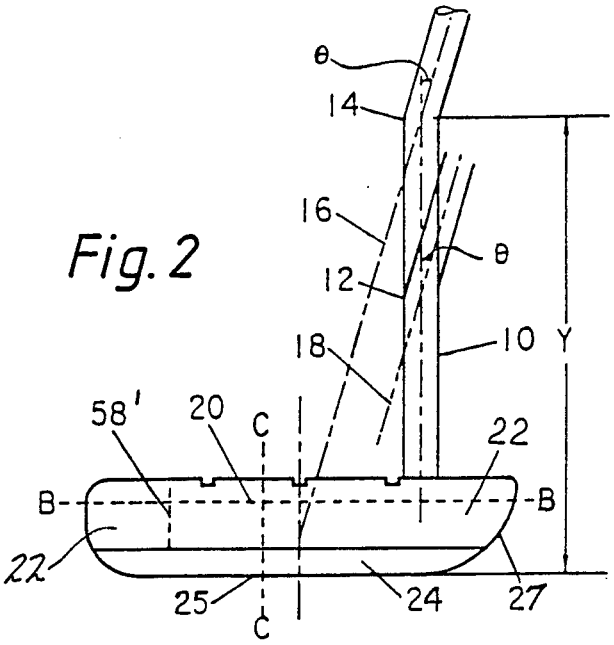
FIG. 2 shows in front elevation a putter according to the present invention.

With reference now to FIG. 2 the putter shown comprises a shaft 10 and a head 20. Only the lower portion of the shaft 10 is shown the upper portion being any suitable standard shaft with preferably a grip of uniform cross-section allowing height adjustment on the shaft without changes of grip.

The shaft is angled as shown at 12 or 14 to alter the characteristics of the putter by effectively altering the theoretical point of entry of the main length of the shaft into the head of the putter as shown by the dotted continuation lines 16, 18. The minimum for angle Θ at present defined by R & A laws of golf is presently 12.5° and the maximum of height Y (the distance from the sole of the putter to the bend point in the shaft) is at present 5 inches to prevent the croquet type of putting stroke.

Figure 3:
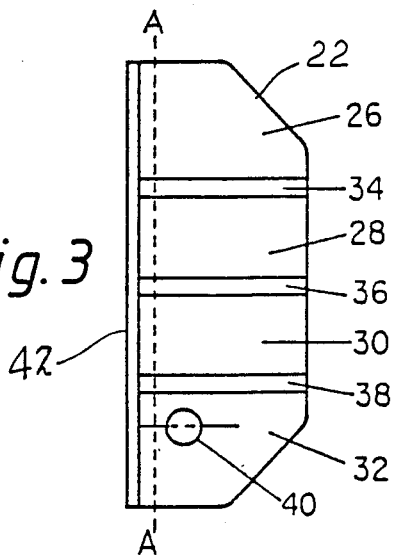
FIG. 3 shows the head of the putter of FIG. 2 in plan view.

The head 20 of the club comprises a first upper portion 22 and a second base plate portion 24. The upper portion 22 (FIG. 3) is preferably coloured on its top surface in areas 26, 28, 30, 32 and three lines 34, 36, 38 are provided on the top surface either by using a different colour or, for example, by anodising areas 26, 28, 30, 32 for an alloy top portion and masking lines 34, 36, 38. Alternatively the upper surface of the club could be moulded (or machined) to be cut away between the lines 34, 36, 38 to leave these lines standing proud on the top surface of the club.

The upper section 22 is provided with a hole 40 in area 32 for reception of the shaft 10 which may be fixed by any conventional method e.g. brazing, welding, soldering or glueing dependent on the material used.

Preferably the shaft 10 will be tempered steel (with a chrome plated finish) or carbon fibre, the upper section 22 will be of a light material such as a light metal alloy or tough plastic and the base plate 24 will be made from a heavy metal such as brass or phosphor bronze.

Figure 4:
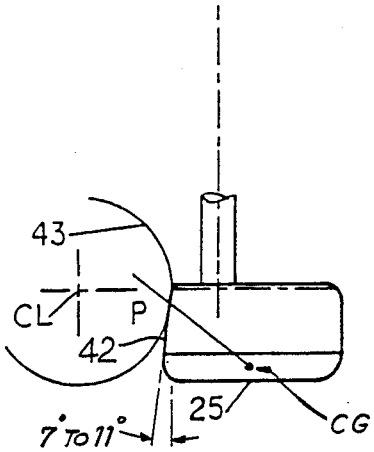
FIG. 4 shows the head of the putter of FIG. 2 in end elevation.

With reference to FIG. 4 the front face 42 of the putter is angled as shown at an angle preferably averaging between 7 to 11 degrees on a radius of curvature of 180 mm. However angles less than this could be used.

Figure 5:
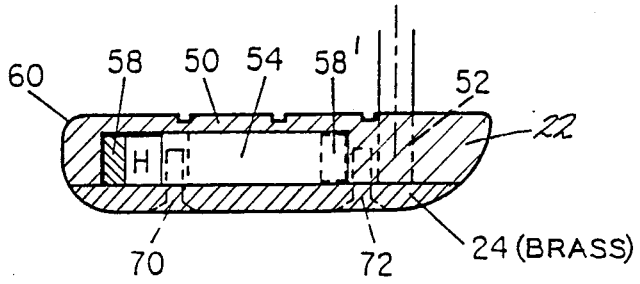
FIG. 5 shows a cross-sectional view along line A—A of FIG. 3.
Figure 6:
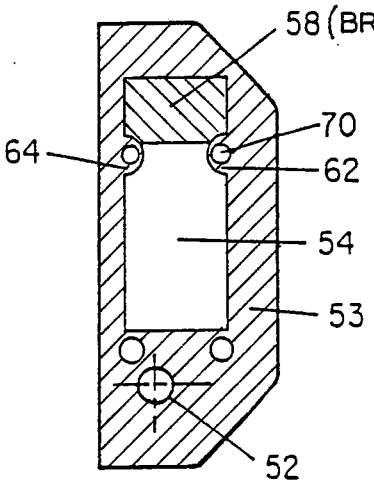
FIG. 6 shows a cross-sectional view along line B—B of FIG. 2.
Figure 7:
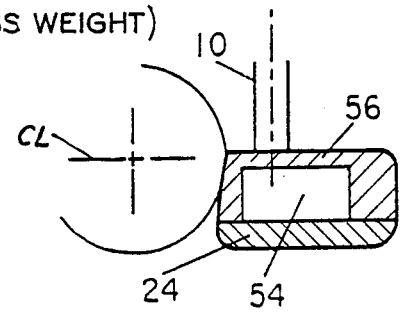
FIG. 7 shows a cross-sectional view along line C—C of FIG. 2.

The upper portion 22 of the putter (FIG. 5) is constructed by commencing with a solid block of alloy (preferably aluminum alloy) 50 and machining out areas 52 and 54. Alternatively it may be cast in a predetermined shape. Area 52 forms the hole 40 for shaft 10, and area 54 is a hollow to lighten the upper section 22. A portion of the rear wall 53 may be omitted if desired to give the club a recessed back. Within the area 54 a heavy weight 58 is positioned towards the front or toe of the putter 60. The weight 58, preferably of brass or other non-rusting metal may be held in position by pillars 62, 64 into which securing screws 70 are screwed to hold on plate 24. The weight 58 may be adjustable by, for example, adjusting its height H (FIG. 5). The weight 58 is preferably glued in position. If a redistribution of weight is required the weight 58 may be supplemented by a weight 58' at the other end of area 54.

The base plate 24 is shown preferably fixed to the upper section 50 by screws shown, for example, at 70, 72. The plate could be glued and screwed on if required but a waterproof glue would be required.

The front face 42 of the putter is designed to have a curved face, in the vertical plane (see FIG. 4). This curve is calculated and used to ensure that the golfer strikes the ball 43 shown partially in substantially the same place P each time in relation to it's vertical diameter. The ball will always be hit below it's centre line CL wherever the golfer positions his hands relative to the ball, i.e. if his hands are in front of the ball or behind the ball, as in the case for uphill or downhill putts, the ball will still be hit in substantially the same place.

Together with this curvature and angle of the face and the very low centre of gravity CG of the putter, the resultant line of force from the centre of gravity and through the point of contact on the ball will always be on a line above the centre of the ball. This in effect lifts the ball. It secures a more on-line start for the ball, because it ensures that all localised effects of the ground are eliminated at the critical stage of impact.

In the preferred putter the three lines 34, 36, 38 on the top of the upper section all run from the front face to the back and are at right angles to the front face 42. All three lines are 3 mm wide and ½ mm deep. The middle line 36 is positioned to indicate the centre of the putter and the other two 34, 38 one either side of this, to line up with the diameter of a golf ball.

The putter has a flat sole provided by the underneath surface 25 of base plate 24. As may be seen the area 25 is substantial allowing the golfer to place the club in the correct position by, for example, resting the face 25 flat on the green.

The heel of the putter 23 has a radius to ensure that when the putter is used with it's "toe in the air"—so that the angled face is slightly closed to the line—the general body of the putter will still be in the vertical plane, i.e. normal to the ground. This is designed to overcome the opening of the putter head when the head makes contact with the ball and the tendency to leave the putter head slightly open when playing in the pressure of competition.

The weight 58 may be moulded integrally with the base plate 24 thereby reducing the number of component parts for the head of the club to two. As shown by dotted line 58' in FIG. 2 the weight 58 can also be made to form part of the front face of the club by shaping it to conform to the front contour. If made of brass the weight will contrast with the alloy giving a distinctive appearance for the club.

Figure 8:
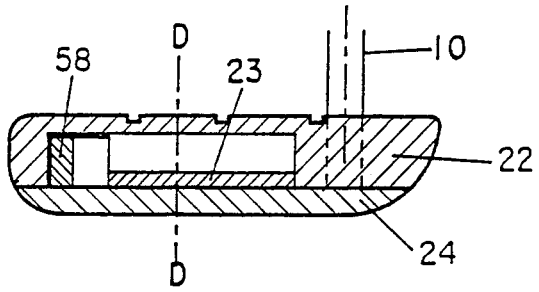
FIG. 8 shows a cross-sectional view along line A—A of FIG. 3 for an alternative design of putter according to the present invention.
Figure 9:
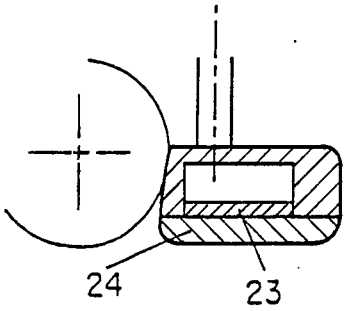
FIG. 9 shows a cross-sectional view along line D—D of the putter shown in FIG. 8.

With reference now to FIGS. 8 and 9 the sole plate 24 can be provided with an additional central weight 23 formed integrally with plate 24 or affixed thereto. This increases the swing weight of the putter.

If a substantially heavier or lighter putter is required the depth of the plate 24 can be increased or decreased.

The upper section 22 can be cast to minimise costs and, if a standard type of putter was required the weight 23 could be omitted. A range of putters could be produced with varying weights of base plate and standard set weights 58.

Alternatively for club professional use a kit could be produced comprising an upper portion 22, a variety of thicknesses of base plate 24 and a series of adjustable weights 58, 23 and 58'. The exact characteristics of the club could then be accurately matched to the golfer and to the style of putting.

Preferred dimensions for the putter are as follows:

Overall length of blade 22, 100 mm
Length of sole plate 25, 91 mm
Overall height (depth), 22 mm
Depth of base plate 24, 6 mm
Width of blade, 38 mm
Distance between lines 34, 36 and 36, 38, 47 mm
Approximate weight, 500 grammes (17 oz)

The principles used in the putter can be applied to the wood. The additional weight is positioned towards the toe of the wood to create a sweet area and correctly position it on the face. Thus, the tolerance of strike position is increased thereby enabling the amateur golfer to play more consistently. Alternatively by using the above mentioned "kit" approach a wood could be readily modified by a club professional for the better golfer to suit the individual swing and/or readily modified if a change of swing was required or to compensate for errors in a swing.

Alternatively by varying the density of the material in the club vertically and horizontally, a weight distribution similar to that as the putter can be achieved.

Irons by law have a heel entry for the shaft. The design method outlined here for the putter can be used on the irons by placing much of the weight towards the toe. This produces a more consistent hit for the amateur.

We claim:

1. A golf club comprising a shaft and a head, the head having heel and toe ends defining a geometric length of the club and front, rear, top and bottom surfaces and including a fixing hole for the shaft, the fixing hole being offset from the center of gravity of the head towards the heel end of the head, in which the head comprises an upper lightweight block and a lower base plate member of denser material secured to the upper lightweight block and in which a weight means is provided in the head such that the distribution of weight in the geometric half of the head at the toe end is significantly greater than the distribution of weight in the geometric half of the head at the heel end.

2. A golf club as claimed in claim 1 in which the upper lightweight block is hollow in part and is designed to house an added weight or weights.

3. A golf club as claimed in claim 2 in which one of the added weights is formed integrally with the base plate member.

4. A golf club as claimed in claim 2 in which the added weight or weights are positioned at the toe end of the upper lightweight block.

5. A golf club as claimed in claim 2 in which the center of gravity of the head lies on a vertical line between the point of entry of the shaft into the upper lightweight block and the toe of the club the position of the vertical line being adjustable in accordance with the position and weight of the additional weight or weights.

6. A golf club as claimed in claim 5 in which the centre of gravity lies in a horizontal plane intercepting the vertical line at a distance less than half the height of the head of the club from the bottom surface of the club.

7. A golf club as claimed in claim 1 in which the base plate and the weight means are made of brass.

8. A golf club as claimed in claim 1 in which the under surface of the base plate member forms a substantially flat base for the head.

9. A golf club as claimed in claim 8 in which the base plate and upper lightweight block are shaped at the toe end of the club to provide a rounded bottom edge at the toe end of the club.

10. A golf club as claimed in claim 8 in which the base plate and upper lightweight block are shaped at the heel end of the club to provide a rounded bottom edge at the heel end of the club.

11. A golf club as claimed in claim 10 in which the rounded bottom edge at the heel end of the club has a curvature the center of which is substantially coincident with the center point of the entry of the shaft into the hole in the upper lightweight block.

12. A golf club as claimed in claim 1 in which the upper lightweight block and lower base plate member form the front surface of the club which in use strikes the golf ball, which front surface is curved and inclined backwards from the bottom to the top of the surface.

13. A golf club as claimed in claim 12 in which the angle of inclination of the front surface is between 7 and 11 degrees and the curvature is on a radius of 180 mm.

14. A golf club as claimed in claim 1 in which the shaft is bent at a predetermined angle a short distance above the point of entry of the shaft into the upper lightweight block.

15. A golf club as claimed in claim 1 in which the shape of the head of the club is substantially rectangular in plan and in which the upper surface of the upper lightweight block is provided with three equidistantly spaced parallel lines, substantially at right angles to the front surface of the head, the lines providing a guide for the positioning of the head when striking a golf ball.

* * * * *